US008317231B2

(12) United States Patent
Heim et al.

(10) Patent No.: US 8,317,231 B2
(45) Date of Patent: Nov. 27, 2012

(54) SECURITY ELEMENT WITH METALLIZATION

(75) Inventors: Manfred Heim, Munich (DE); Bernhard Wiedner, Miesbach (DE); Marius Dichtl, Munich (DE); Mario Keller, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 491 days.

(21) Appl. No.: 12/515,923

(22) PCT Filed: Nov. 8, 2007

(86) PCT No.: PCT/EP2007/009687

§ 371 (c)(1),
(2), (4) Date: May 21, 2009

(87) PCT Pub. No.: WO2008/061636

PCT Pub. Date: May 29, 2008

(65) Prior Publication Data

US 2010/0207376 A1 Aug. 19, 2010

(30) Foreign Application Priority Data

Nov. 23, 2006 (DE) ..... 10 2006 055 680

(51) Int. Cl.
*B42D 15/00* (2006.01)

(52) U.S. Cl. ..... 283/94

(58) Field of Classification Search ..... 283/94
See application file for complete search history.

(56) References Cited

U.S. PATENT DOCUMENTS

| | | | | |
|---|---|---|---|---|
| 5,176,405 | A | 1/1993 | Kaule et al. | |
| 5,214,530 | A * | 5/1993 | Coombs et al. | 359/359 |
| 5,766,738 | A * | 6/1998 | Phillips et al. | 428/200 |
| 5,790,298 | A * | 8/1998 | Tonar | 359/267 |
| 6,154,311 | A * | 11/2000 | Simmons et al. | 359/359 |
| 6,243,204 | B1 * | 6/2001 | Bradley et al. | 359/585 |
| 7,479,320 | B2 | 1/2009 | Keller et al. | |
| 7,667,894 | B2 | 2/2010 | Hoffmuller | |
| 7,728,931 | B2 | 6/2010 | Hoffmuller | |
| 7,808,605 | B2 | 10/2010 | Hoffmuller | |
| 2003/0161025 | A1 * | 8/2003 | Asano et al. | 359/264 |
| 2005/0127663 | A1 * | 6/2005 | Heim | 283/72 |

(Continued)

FOREIGN PATENT DOCUMENTS

EP 0400902 A2 12/1990

(Continued)

OTHER PUBLICATIONS

International Search Report, International Application No. PCT/EP2007/009687, 3 pages, Jun. 19, 2008.

(Continued)

*Primary Examiner* — Lesley D Morris
*Assistant Examiner* — Kristina Junge
(74) *Attorney, Agent, or Firm* — Greenlee Sullivan P.C.

(57) ABSTRACT

The present invention relates to a security element (20) for security papers, value documents and the like, having a substrate (22) and an opaque metallization 24, 26) arranged on the substrate. According to the invention in the security element is provided, that the metallization (24, 26) comprises a first opaque metal layer (24) and a second opaque metal layer (26) arranged above the first metal layer (24), and that the two metal layers (24, 26) have substantially the same tone of color in the visible spectral region.

34 Claims, 3 Drawing Sheets

U.S. PATENT DOCUMENTS

Figure 1:
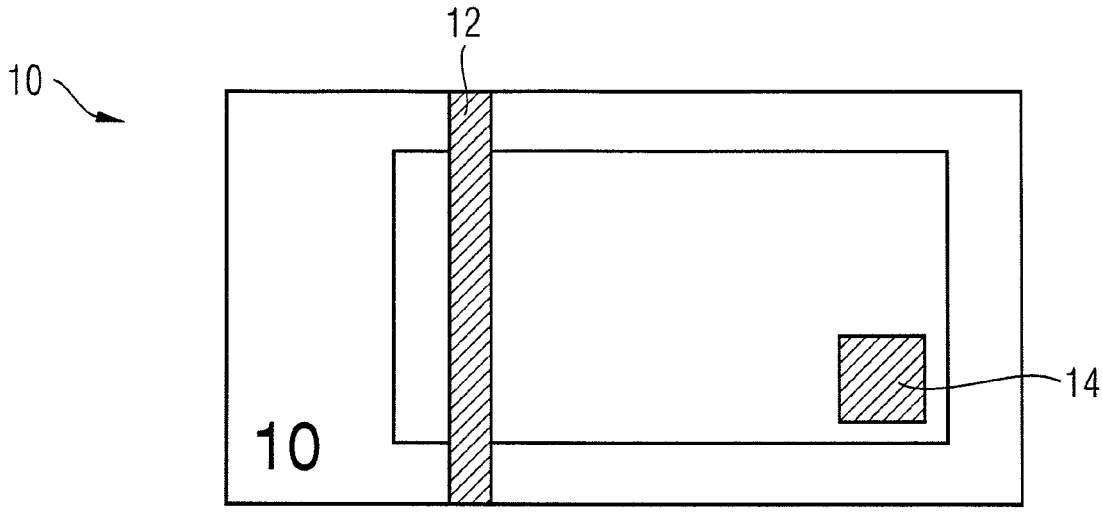

| | | | | |
|---|---|---|---|---|
| 2006/0249042 | A1 | 11/2006 | Heim et al. | |
| 2007/0165182 | A1 | 7/2007 | Hoffmuller | |
| 2007/0211238 | A1 | 9/2007 | Hoffmuller | |
| 2007/0216518 | A1 | 9/2007 | Hoffmuller | |
| 2007/0229928 | A1 | 10/2007 | Hoffmuller | |
| 2007/0241551 | A1 | 10/2007 | Graff | |
| 2007/0241553 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0258456 | A1 | 10/2008 | Rahm | |
| 2009/0001709 | A1 | 1/2009 | Kretschmar | |
| 2009/0008923 | A1 | 1/2009 | Kaule | |
| 2009/0008926 | A1 | 1/2009 | Depta | |
| 2009/0102605 | A1 | 4/2009 | Kaule | |
| 2009/0115185 | A1 | 5/2009 | Hoffmuller | |
| 2009/0236061 | A1 | 9/2009 | Gruszczynski | |
| 2009/0251749 | A1* | 10/2009 | O'Boyle et al. | 359/2 |
| 2009/0297805 | A1 | 12/2009 | Dichtl | |
| 2009/0322071 | A1 | 12/2009 | Dichtl | |
| 2010/0194091 | A1 | 8/2010 | Heim | |

FOREIGN PATENT DOCUMENTS

| | | | |
|---|---|---|---|
| EP | 1023499 | B1 | 5/2004 |
| GB | 2250473 | A | 6/1992 |
| WO | WO 90/13877 | A1 | 11/1990 |
| WO | WO 97/40464 | A2 | 10/1997 |
| WO | WO 99/13157 | A1 | 3/1999 |
| WO | WO 02/18155 | A2 | 3/2002 |
| WO | WO 03/053714 | A1 | 7/2003 |
| WO | WO 03/091042 | A2 | 11/2003 |
| WO | WO 2005/077668 | A1 | 8/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018172 | | 2/2006 |
| WO | WO 2006040069 | | 4/2006 |
| WO | WO 2006056342 | | 6/2006 |
| WO | WO 2006072380 | | 7/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007006445 | | 1/2007 |
| WO | WO 2007006455 | | 1/2007 |
| WO | WO 2007076952 | | 7/2007 |
| WO | WO 2007079851 | | 7/2007 |
| WO | WO 2007115648 | | 10/2007 |
| WO | WO 2008/000350 | | 1/2008 |
| WO | WO 2008/000351 | | 1/2008 |
| WO | WO 2008/049533 | | 5/2008 |

OTHER PUBLICATIONS

International Preliminary Report on Patentability, International Application No. PCT/ EP2007/009687, 5 pages, May 27, 2009, English Translation.

Stramm P. C., "Transparente anorganische Barriere-schichten fur Kunststoffverpackungen," Coating Jul. 2005, 3 pages, Article in German, Abstract in English.

* cited by examiner

SECURITY ELEMENT WITH METALLIZATION

CROSS-REFERENCE TO RELATED APPLICATIONS

This application is the U. S. National Stage of International Application No. PCT/EP2007/009687, filed Nov. 8, 2007, which claims the benefit of German Patent Application DE 10 2006 055 680.1, filed Nov. 23, 2006; both of which are hereby incorporated by reference to the extent not inconsistent with the disclosure herewith.

The invention relates to a security element for security papers, value documents and the like having a substrate and an opaque metallization arranged on the substrate. The invention further relates to an associated production method, a security paper as well as a data carrier having such a security element.

Value objects, such as branded articles or value documents, are often provided with security elements for protection, which allow a verification of the genuineness of the value object and which serve at the same time as protection from unauthorized reproduction.

A number of these security elements, such as hologram bands or so-called hologram-patches comprise thin opaque metal coatings which typically have a thickness between 10 nm and about 100 nm. Due to the good availability, the excellent reflection properties, the relatively good chemical durability and the low cost predominantly aluminum is employed for the metal coatings of bank note holograms, security threads and the like.

Bank notes are possibly exposed to strong mechanical and partially also chemical stress during their circulation. Thereby it has been observed, that the thin aluminum coatings of the security elements may corrode and thereby may be strongly damaged, whereby the optical impression of the banknote is strongly altered. Chemically very durable metals, such as gold, palladium or platinum, are generally considerably too expensive for a use in security elements. Other chemically more durable metals than aluminum are indeed more inexpensive, but optically less brilliant ant therefore visually less appealing.

From this starting point the invention is based on the object to avoid the disadvantages of the state of the art. In particular, a security element of the type stated in beginning, having improved circulation durability and/or increased counterfeiting security shall be specified.

This object is solved by the security element having the features of the main independent claim. A corresponding production method as well as a security paper and a data carrier, which are provided with such a security element are specified in the other independent claims. Developments of the invention are subject of the subclaims.

According to the invention in a security element of the generic kind it is provided that the metallization comprises a first opaque metal layer and a second opaque metal layer arranged above the first metal layer, and that the two metal layers have substantially the same tone of color in the visible spectral region. Thereby, complete identity in tone of color is not required. As explained in the following in more detail it is sufficient for the purpose of the invention if the tones of color of the two metal layers are as similar to each other, that they appear the same at swift observation.

In an advantageous development of the invention, the two metal layers differ significantly in their chemical and/or mechanical durability. An increased circulation durability is in particular achieved if the second metal layer is chemically and/or mechanically more durable than the first metal layer.

Despite their substantially equal tone of color, the metal layers can differ in their reflectivity, wherein the arrangement of the metal layers is advantageously chosen for a good visual impression such, that the first metal layer reflects stronger than the second metal layer.

The layer thickness of thin layers is typically given in units of the optical density, which is a measure for the attenuation experienced by the light when passing through the thin layer. As optical density OD the decade logarithm of the quotient of 100 and the transmission (in percent), thus OD=log (100/T) is denoted. For example, an optical density of 1.0 corresponds to an attenuation of the light to one tenth of the original irradiance, an optical density of 2.0 to an attenuation to one hundredths.

For the purpose of the invention "opaque" is to be understood as an optical density of at least 0.5, preferably of at least 0.7, especially preferably of at least 1.0.

According to an advantageous embodiment of the invention, the layer thicknesses of the two metal layers are chosen such, that their optical density is substantially the same. For example, the optical densities of the two metal layers may differ by less than 0.3, in particular by less than 0.2.

While good reflection properties and good corrosion durability may be obtained already starting at an optical density of about 0.5, the optical density of the two metal layers is preferably larger than 1.0, in particular larger than 1.2, respectively. Thereby it is expedient, if the two metal layers are adapted to each other such, that the optical density of the opaque metallization, therefore of the two metal layers together, is between 1.5 and 5.0, preferably between 1.5 and 3.0.

For the second metal layer a layer of a corrosion-resistant metal, in particular a platinum layer, a palladium layer or a chrome layer advantageously comes into consideration in line with the invention. Currently, the use of a chrome layer is particularly preferred, as this material combines low cost, high durability and still relatively good reflection properties. The second metal layer is therefore preferably a chrome layer, in particular having a thickness of about 25 nm or more.

Due to its excellent reflection properties, the use of aluminum layers, in particular having a thickness of 15 nm or more, is preferred for the first metal layer.

The combination of a chrome layer as second metal layer with an aluminum layer as first metal layer is particularly advantageous, as chrome and aluminum both have a substantially flat reflection spectrum in the visible spectral region and therefore both effect a white color impression. In this way, the advantages of the high reflectivity of aluminum and the high durability of chrome may be combined with each other. In case of a substantially undamaged aluminum layer, the visual impression of the metallization of the security element is determined by the highly glossy aluminum layer.

In case the aluminum layer obtains defects or cracks by great wear and tear the chrome layer with its substantially equal tone of color takes over the light reflection. The smaller reflectivity of the chrome layer is thereby, especially in greatly used banknotes, practically non-apparent for the bare eye. The characteristic appearance of the metallization of the security element therefore remains intact also in case of great wear and tear.

According to a development of the invention a spacing layer is provided between the two metal layers, which in particular forms an electrical and/or chemical isolation layer. The spacing layer is advantageously formed by a transparent printing layer or a transparent vapor deposited layer. In an expedient embodiment the spacing layer is formed by a ceramic layer, in particular a $SiO_X$-layer, an $Al_2O_3$-layer, a $MgF_2$-layer, or also by an organic layer. Alternatively or additionally the spacing layer may form a barrier layer against the permeation of gases and vapors, in particular of oxygen and hydrogen.

In particularly preferred embodiments of the invention the security element comprises a diffraction structure in form of a relief structure. The diffraction structure thereby advantageously encompasses an embossing lacquer layer and at least a partial area of the metal layers. In case certain partial areas of the diffraction structure are to be optically accentuated, advantageously the first metal layer may be present only in these partial areas. The security element then comprises first areas, in which the first metal layer is visible, and second areas, in which the second metal layer is visible. Although the optical impression in both areas is naturally very similar due to the substantially equal tone of color, nuances in the appearance of the partial areas may be perceived in case of different reflection properties of the metal layers.

Besides diffraction structures the security element may also comprise scattering structures (matte patterns), anti-reflection topographies, refractive structures, zero order gratings, blazed gratings, optically variable topographies by means of micromirrors and/or retro-reflective structures.

In further advantageous embodiments the two metal layers comprise gaps in the form of patterns, characters or a code, which reach through both metal layers. In the area of the gaps the security element may then be transparent or translucent, or an information arranged below the metallization may emerge.

The security element preferably represents a security thread, a security band or a patch.

The invention also comprises a method of producing a security element for security papers, value documents and the like, in which a substrate is provided, a first opaque metal layer is arranged on substrate, and a second opaque metal layer is arranged above the first metal layer, which second metal layer has substantially the same tone of color in the visible spectral region as the first metal layer.

The two metal layers are thereby preferably applied by means of a vacuum coating process. In a particularly advantageous method an aluminum layer is applied as first metal layer and a chrome layer as second metal layer.

Between the first and the second metal layer a spacing layer may be applied, which is expediently printed or vapor deposited in a vacuum coating process.

In a development of the method according to the invention the security element is provided with a diffraction structure in form of a relief structure. Thereby, an embossing lacquer is applied onto the substrate, the embossing lacquer is embossed into the form of a desired diffraction structure and the first and second metal layer are applied one after the other, when indicated by interposition of a spacing layer, onto the embossed lacquer layer.

Gaps reaching through both metal layers and being in the form of patterns, characters or a code, may by introduced into the metal layers, in particular using the washing process known from the document WO 99/13157 A1.

The invention further comprises a security paper for the manufacture of value documents or the like as well as a data carrier, in particular a value document, such as a bank note, an identity card or the like. The security paper and the data carrier, respectively, are equipped with a security element of the described type according to the invention.

Further exemplary embodiments and advantages of the invention are explained below by reference to the figures, in which a depiction to scale and proportion was dispensed with in order to improve clarity.

Shown are:

FIG. 1 a schematic representation of a bank note comprising security elements according to the invention, and FIG. 2 to 6 cross-sections through security elements according to different exemplary embodiments of the invention.

The invention is now illustrated using security elements for bank notes as example. To that regard FIG. 1 shows a schematic representation of a bank note 10, which is provided with two metallized security elements of high circulation durability according to the invention. The first security element represents a security thread or a security band 12, the second security element is formed by a bonded transfer element 14 of arbitrary shape.

The layer composition of security elements according to the invention and the effect according to the invention are now described in more detail based on the sectional representations of FIGS. 2 to 6, wherein only the layers essential for the invention are shown, respectively. Depending on the intended application, the finished security elements certainly will contain further layers known to the person skilled in the art, such as gluing layers, protection layers, primers or the like.

Figure 2:
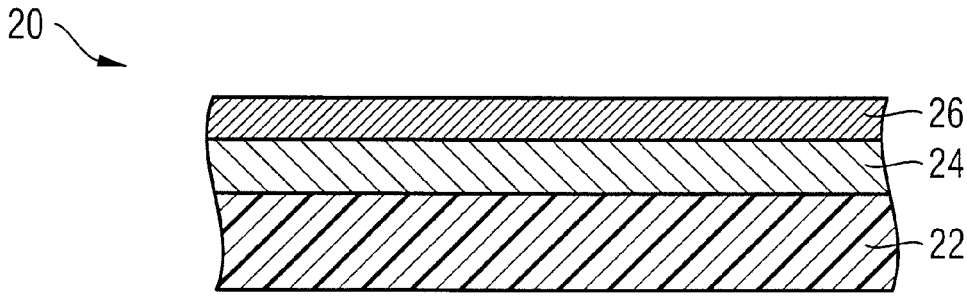

The security element 20 of FIG. 2 comprises a plastic foil 22 as substrate, on which two opaque metal layers 24 and 26 are vapor deposited on top of each other, which have substantially the same tone of color in the visible spectral region. In the exemplary embodiment the first metal layer 24 is formed by a thin aluminum layer, the second metal layer 26 by a thin chrome layer.

The layer thicknesses of the two metal layers are thereby chosen such, that the optical density of the aluminum layer and of the chrome layer is about 1.5, respectively.

The vapor deposited chrome layer 26 and the aluminum layer 24 both have an almost flat reflection spectrum in the visible spectrum region and therefore appear of having white color impression. The reflectivity of the chrome layer 26, however, is at about 50% smaller than the reflectivity of the aluminum layer 24, which is about 90%, so that the chrome layer with the same tone of color appears by itself somewhat darker than the aluminum layer.

The metallized substrate is preferably applied onto a security paper with the metallized side, so that the substrate foil 22 points to the viewer.

The chrome layer 26 is then, as seen by the viewer, covered completely by the opaque aluminum layer 24, so that the overall visual impression of the security element is given only by the highly glossy aluminum layer 24. Depending on the embodiment, the substrate 22 may remain on the already applied security element or may preferably be removed.

During the circulation of the banknotes provided with the security element 20 partial corrosion of the thin aluminum layer 24 may occur in case of particularly high wear and tear, for example in tropical countries or in case of high exposure to sweat. The aluminum layer, which is less durable with regard to highest levels of wear and tear may thereby obtain light transmitting cracks and defects.

In these light transmitting areas the chrome layer, which is chemically and mechanically significantly more durable, takes over the light reflection according to the invention. The reflectivity of the chrome layer 26 may be somewhat smaller than the same of the aluminum layer 24, but the change of the reflecting metal area is hardly apparent for the viewer, especially in case of mechanically and/or chemically highly stressed bank notes. In particular, also in case of high wear and tear the basic optical impression of the security element, namely its metallic appearance and the color impression of the metallization is preserved.

Increased circulation durability can be preserved in a wide area of layer thicknesses for the two metal layers 24, 26. For the first metal layer, which points towards the viewer, layer thicknesses starting at an optical density of about 0.5 are possible, for a very good visual impression and high reflection, however, optical densities of 1.0 or more are typically chosen.

Also the second, highly durable metal layer leads starting at an optical density of 0.5 already leads to a significant increase in the circulation durability of the security element. In case of the utilization of chrome layers optical densities above 1.0 have proven of value for a good corrosion protection. In case very costly metals, such as platinum and palladium are used for the second metal layer, the second metal layer is formed due to cost reasons in the minimally necessary layer thickness, so that also optical densities significantly below 1.0 are possible.

The thicknesses of both metal layers are advantageously adapted to each other according to the invention such, that the optical density of the metal layers together is above 1.5, in particular in the region of 1.5 to 3.0. In the exemplary embodiment of FIG. 2, the optical densities of the metal layers add up to $OD_{ges}=OD_{Al}+OD_{Cr}=1.5+1.5=3.0$.

Figure 3:
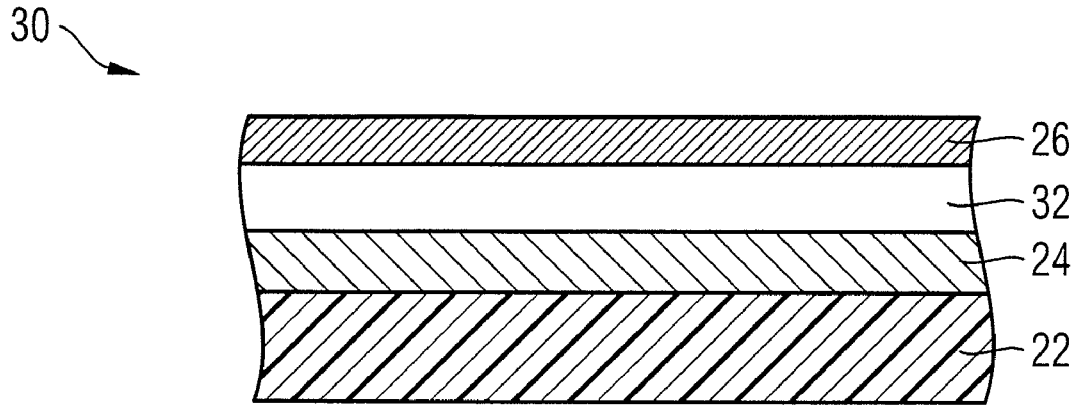

In the further exemplary embodiment of FIG. 3, between the two metal layers 24, 26 of the security element 30 an electrically and, if applicable, also chemically isolating transparent spacing layer 32 is arranged. The spacing layer 32 may in particular prevent a local element formation and thereby an accelerated corrosion due to pitting.

Transparent printing layers, transparent layers applied in a vacuum coating process, such as layers of $SiO_x$, wherein x is between 1.5 and 2, $Al_2O_3$ or $MgF_2$, but also organic coatings are possible as suitable spacing layers. The layer thickness of the spacing layer 32 is of little significance and may be between 10nm and several micrometers.

Instead of or in addition to its electrical isolation, the spacing layer 32 may also be configured as a barrier layer against the permeation of gases and vapors, in particular of oxygen and hydrogen.

Figure 4:
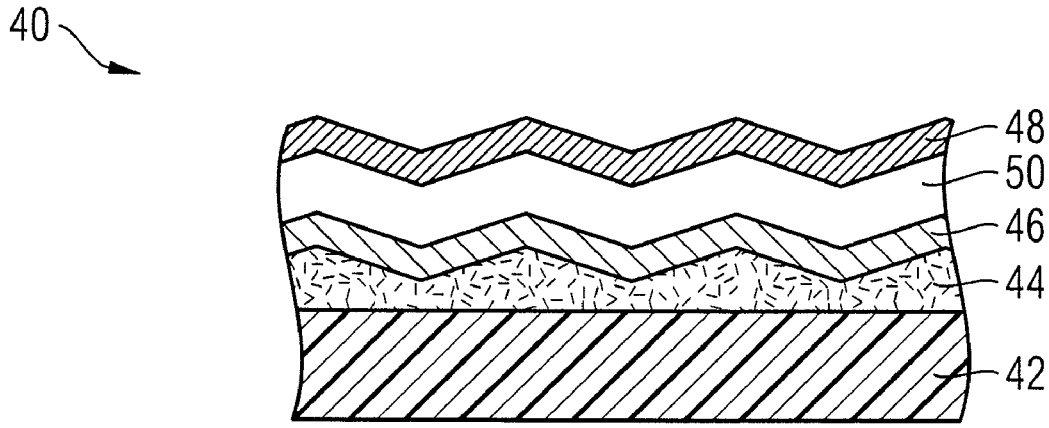

FIG. 4 shows a security element 40 provided with a metallized hologram as a further exemplary embodiment of the invention. In this case an embossing lacquer layer 44 was printed onto a carrier foil 42, and the desired diffraction structure of the hologram was embossed in form of a relief structure.

In order to obtain the described advantages of increased circulation durability, a first metal layer 46 of aluminum and a second metal layer 48 of chrome is applied as a hologram metallization. Between the two metal layers 46, 48 a spacing layer 50 be provided. Due to the variable surface topography of the relief structure the spacing layer 50 has to be in the position to follow the surface topography of the first metal layer 46. For this purpose in particular ceramic, transparent vapor deposition layers, such as $SiO_x$, $Al_2O_3$ or $MgF_2$, having layer thicknesses of 10 nm or more, are suitable. Also thin organic coatings, which follow the surface topography, may be used.

In further embodiments, the security elements according to the invention may also contain negative information in the form of patterns, characters or codes, which are formed by corresponding gaps in the metallization. For illustration FIG. 5 shows a security element 60, in which a substrate 62 is provided with a metallization 64, which is formed by an aluminum layer 66, a transparent ceramic spacing layer 68 and a chrome layer 70.

The metallization 64 may also form a metal coating of a diffraction structure, such as a hologram. In this case the substrate 62 comprises in addition to a carrier foil in particular also an embossed lacquer layer, as shown for example in FIG. 4.

Figure 5:
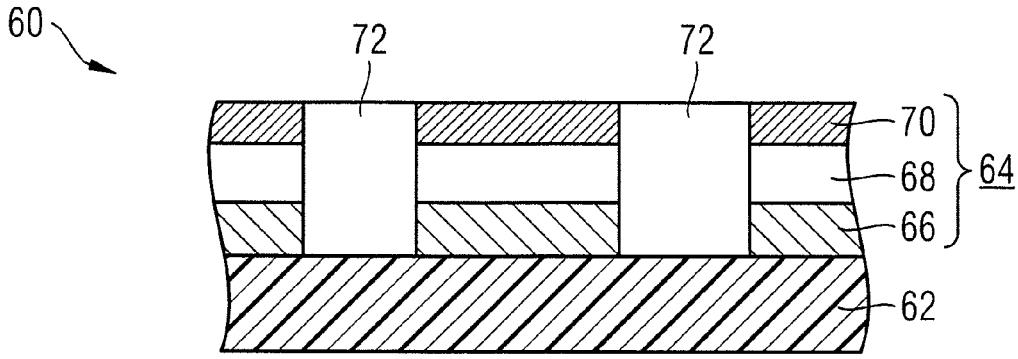

Reverting back to FIG. 5, gaps 72 in the form of the desired negative information, for example in the form of negative text, are introduced into the metallization 64, wherein the gaps 72 reach through both metal layer 66, 70 and the ceramic spacing layer 68. The demetallized areas 72 may for example be generated by means of a washing process, as known from the document WO 99/13157 A1.

Figure 6:
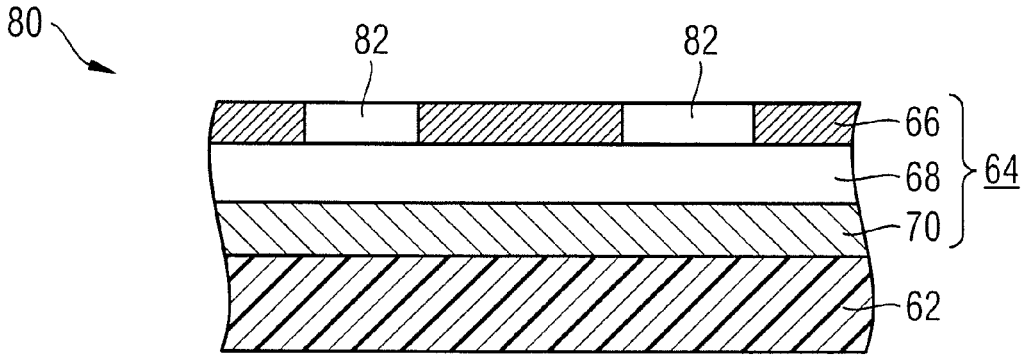

A further embodiment of the invention is illustrated in FIG. 6. The security element 80 shown there corresponds in its layer composition largely to the security element 60 of FIG. 5, however with the difference, that the chrome layer 70 is applied as first metal layer and an aluminum layer 66 as second metal layer and that now gaps 82 are provided, which are only present in the aluminum layer 66. This security element is viewed from the side having the aluminum layer 66.

In this variant according to the invention the second metal layer 70 is applied onto the first metal layer only in partial areas. In this novel security element 80 nuanced visual appearances may be perceived in the areas with and without gaps 82, respectively, due to the different reflectivities of the two metal layers 66, 70. Although the optical impression in the two areas is according to the interpretation very similar, minute differences of certain design elements, in particular holograms (FIG. 4) may be stressed and accentuated.

With increasing wear of the security element 80 the recognizability of the nuanced appearances formed by the shape and position of the gaps 82 decreases typically and may finally disappear completely in case of the highest level of wear. The increased circulation durability of the security element 80, however, is secured by the highly resistant chrome layer 70, even in case of the highest level of wear.

The invention claimed is:

1. A security element for security papers or value documents, comprising a substrate and an opaque metallization arranged on the substrate, characterized in that the metallization comprises a first opaque metal layer having an optical density of at least 0.5 and a different second opaque metal layer arranged above the first metal layer and having an optical density of at least 0.5, wherein the two metal layers have substantially the same tone of color in the visible spectral region and differ significantly in their chemical and/or mechanical durability;

wherein the optical density of each of the two metal layers is larger than 1.2; and wherein the second metal layer is a corrosion-resistant metal layer of platinum, palladium, or chrome.

2. The security element according to claim 1, characterized in that the second metal layer is chemically and/or mechanically more durable than the first metal layer.

3. The security element according to claim 1, characterized in that the metal layers differ in their reflectivity and the first metal layer reflects more strongly than the second metal layer.

4. The security element according to claim 1, characterized in that the optical density of the two metal layers is substantially the same.

5. The security element according to claim 1, characterized in that the optical density of the two metal layers together is between 1.5 and 5.0, preferably between 1.5 and 3.0.

6. The security element according to claim 1, characterized in that the second metal layer is a chrome layer having a thickness of about 25 nm or more.

7. The security element according to claim 1, characterized in that the first metal layer is an aluminum layer.

8. The security element according to claim 7, characterized in that the aluminum layer has a thickness of about 15 nm or more.

9. The security element according to claim 1, characterized in that a spacing layer is provided between the metal layers.

10. The security element according claim 9, characterized in that the spacing layer forms an electrical and/or chemical isolation layer.

11. The security element according claim 9, characterized in that the spacing layer is formed by a transparent printing layer or a transparent vapor deposited layer.

12. The security element according to claim 9, characterized in that the spacing layer is formed by a ceramic layer, in particular a $SiO_x$-layer, an $Al_2O_3$-layer or a $MgF_2$-layer, or by an organic layer.

13. The security element according to claim 9, characterized in that the spacing layer forms a barrier layer against the permeation of gases and vapors, in particular of oxygen and hydrogen.

14. The security element according to claim 1, characterized in that the security element comprises a diffraction structure in form of a relief structure.

15. The security element according to claim 14, characterized in that the diffraction structure encompasses an embossed embossing lacquer layer and at least a partial area of the metal layers.

16. The security element according to claim 1, characterized in that the metal layers comprise gaps reaching through both metal layers and being in the form of patterns, characters or a code.

17. The security element according to claim 1, characterized in that the first metal layer is not contiguous.

18. The security element according to claim 1, characterized in that the security element represents a security thread, a security band or a patch.

19. A security paper for the manufacturing of value documents, which is provided with the security element according to claim 1.

20. A data carrier, in particular a value document, such as a bank note or an identity card, which is provided with the security element according to claim 1.

21. A use of the security element according to claim 1, of a security paper provided with the security element, or of a data carrier provided with the security element for protection of goods against counterfeiting.

22. A method of producing a security element for security papers or value documents, comprising the steps wherein a substrate is provided, a first opaque metal layer having an optical density of at least 0.5 is arranged on the substrate, and a second different opaque metal layer having an optical density of at least 0.5 is arranged above the first metal layer, which second metal layer has substantially the same tone of color in the visible spectral region as the first metal layer and differs significantly from the first metal layer in its chemical and/or mechanical durability;

wherein the optical density of each of the two metal layers is larger than 1.2; and wherein the second metal layer is a corrosion-resistant metal layer of platinum, palladium, or chrome.

23. The method according to claim 22, characterized in that the two metal layers are applied by means of a vacuum coating process.

24. The method according to claim 22, characterized in that a chrome layer is applied as second metal layer.

25. The method according to claim 22, characterized in that an aluminum layer is applied as first metal layer.

26. The method according to claim 22, characterized in that a spacing layer is applied between the first and the second metal layer.

27. The method according claim 26, characterized in that the spacing layer is printed or vapor deposited in a vacuum coating process.

28. The method according to claim 22, characterized in that the security element is provided with a diffraction structure in form of a relief structure.

29. The method according claim 28, characterized in that an embossing lacquer is applied onto the substrate, the embossing layer is embossed into the form of a desired diffraction structure and the first and second metal layer are applied onto the embossed lacquer layer.

30. The method according to claim 22, characterized in that gaps reaching through both metal layers and being in the form of patterns, characters or a code are introduced into the metal layers.

31. The method according to claim 22, characterized in that the first metal layer is not contiguous.

32. A security paper for the manufacturing of value documents, which is provided with the security element producible according to claim 22.

33. A data carrier, in particular a value document, such as a bank note or an identity card, which is provided with the security element producible according to claim 22.

34. A use of the security element producible according to claim 22 for protection of goods against counterfeiting.

* * * * *